US011014636B1

(12) United States Patent
Cook

(10) Patent No.: US 11,014,636 B1
(45) Date of Patent: May 25, 2021

(54) USER PROPELLED FLOTATION AND TRANSPORTATION SYSTEM

(71) Applicant: Clyde Cook, Andersonville, TN (US)

(72) Inventor: Clyde Cook, Andersonville, TN (US)

( * ) Notice: Subject to any disclaimer, the term of this patent is extended or adjusted under 35 U.S.C. 154(b) by 0 days.

(21) Appl. No.: 17/072,621

(22) Filed: Oct. 16, 2020

(51) Int. Cl.

| | |
|---|---|
| ***B63B 34/56*** | (2020.01) |
| ***B63H 16/00*** | (2006.01) |
| ***B63B 34/40*** | (2020.01) |
| ***B63H 25/38*** | (2006.01) |
| ***B63B 3/14*** | (2006.01) |

(52) U.S. Cl.
CPC ..... *B63B 34/56* (2020.02); *B63B 3/14* (2013.01); *B63B 34/40* (2020.02); *B63H 16/00* (2013.01); *B63H 25/38* (2013.01)

(58) Field of Classification Search
CPC ..... B63B 35/00; B63B 35/83; B63B 34/00; B63B 34/40; B63B 34/56; B63B 3/00; B63B 3/14; B63H 16/00; B63H 25/00; B63H 25/38
USPC ..... 441/76, 77
See application file for complete search history.

(56) References Cited

U.S. PATENT DOCUMENTS 1,552,845 A * 9/1925 Knobloch ..... B63B 34/56 441/77
1,607,244 A * 11/1926 Diller ..... B63B 34/56 441/77
3,084,356 A * 4/1963 Wheat ..... B63B 34/56 441/77
3,112,504 A * 12/1963 Carlton ..... B63B 34/56 441/77
5,277,636 A * 1/1994 Seith ..... B63B 34/56 441/77
8,808,047 B2 * 8/2014 Knutson ..... B63H 16/00 441/76
10,472,027 B1 * 11/2019 Croft ..... B63H 16/04
2007/0077833 A1 * 4/2007 Cherfas ..... B63B 34/56 441/76
2009/0227156 A1 * 9/2009 Wilkinson ..... B63H 16/12 441/76

* cited by examiner

*Primary Examiner* — Lars A Olson
(74) *Attorney, Agent, or Firm* — Pitts & Lake, P.C.

(57) ABSTRACT

A user propelled flotation and transportation system, the system including first and second buoyant floats configured to be selectively attached and detached to a user's feet, each of the first and second floats including an elongate hull having a forward end and a rear end, a foot receiving portion provided on a top surface of the hull, a pair of fins extending downward along a length of the hull and arranged to be substantially parallel to form a channel along a bottom surface of the hull, and one or more flaps arranged between the fins and configured to pivot about a line between the fins that is proximate the bottom surface of the hull, wherein the one or more flaps are configured to be movable between a first position extending downwardly from the bottom surface of the hull, and a second position rotated back toward the rear end of the hull.

18 Claims, 4 Drawing Sheets

USER PROPELLED FLOTATION AND TRANSPORTATION SYSTEM

CROSS-REFERENCE TO RELATED APPLICATIONS

Not applicable.

FIELD OF INVENTION

The present general inventive concept relates to a user propelled flotation system, and, more particularly, to a flotation and transportation system to allow a user to simulate walking across a water surface.

BACKGROUND

There are a host of devices used by humans to self-propel themselves along water, such as canoes, row boats, paddle boats, and so on. There have even been devices that resemble large hamster balls to allow a person inside to traverse the water without getting wet. However, such devices, vessels, etc., are typically large and cumbersome for the user to transport when not in use. Further, humans have long been fascinated with ways in which to "walk on water," which can be fun as a recreational experience, and also has utility to allow a user to cross a stretch of water without getting wet. Therefore, a portable system that would allow a user to walk across the surface of the water in a manner that approaches normal walking, while also being convenient and portable enough to be convenient for a user to transport, would be desirable.

BRIEF SUMMARY

According to various example embodiments of the present general inventive concept, a user propelled flotation and transportation system is provided that allows a user to "walk" across a surface of the water. The system includes a buoyant float for each foot of the user, and is configured with movable flaps that help provide propulsion as the user simulated a walking action when on the water.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a user propelled flotation and transportation system, the system including first and second buoyant floats configured to be selectively attached and detached to a user's feet, each of the first and second floats including an elongate hull having a forward end and a rear end, a foot receiving portion provided on a top surface of the hull, a pair of fins extending downward along a length of the hull and arranged to be substantially parallel to form a channel along a bottom surface of the hull, and one or more flaps arranged between the fins and configured to pivot about a line between the fins that is proximate the bottom surface of the hull, wherein the one or more flaps are configured to be movable between a first position extending downwardly from the bottom surface of the hull, and a second position rotated back toward the rear end of the hull.

The foregoing and/or other aspects and advantages of the present general inventive concept may also be achieved by providing a user propelled flotation and transportation system, the system including first and second buoyant floats configured to be selectively attached and detached to a user's feet, each of the first and second floats including an elongate hull having a forward end and a rear end, a foot receiving portion provided on a top surface of the hull, a pair of fins extending downward along a length of the hull and arranged to be substantially parallel to form a channel along a bottom surface of the hull, and a plurality of flaps arranged between the fins and configured to pivot about a line between the fins that is proximate the bottom surface of the hull, wherein the plurality of flaps are configured to be movable between a first position extending downwardly from the bottom surface of the hull, and a second position rotated back toward the rear end of the hull, a coupling assembly configured to couple facing surfaces of the first and second buoyant floats to one another such that the first and second buoyant floats maintain a substantially constant distance between one another, and move along substantially parallel lines, while in operation, and a rudder assembly arranged on the first buoyant float, the rudder assembly including a rudder arm configured to be selectively positionable in a plurality of secured positions by a user, a rudder arranged proximate a distal end of the rudder arm, and a user interface configured such that the rudder arm is securable in a desired position by the user to place the rudder in a desired direction.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, a user propelled flotation and transportation system is provided that allows a user to "walk" across a surface of the water. The system includes a buoyant float for each foot of the user, and is configured with movable flaps that help provide propulsion as the user simulated a walking action when on the water. The flaps provide resistance against the water as the user "steps" forward with the other foot, and fold back to allow forward movement without that resistance. A rudder system can also be supplied to various example embodiments of the present general inventive concept to allow the user to change direction while "walking," and this rudder system can perform double service as a stabilizing handle for the user in some embodiments.

Figure 1A:
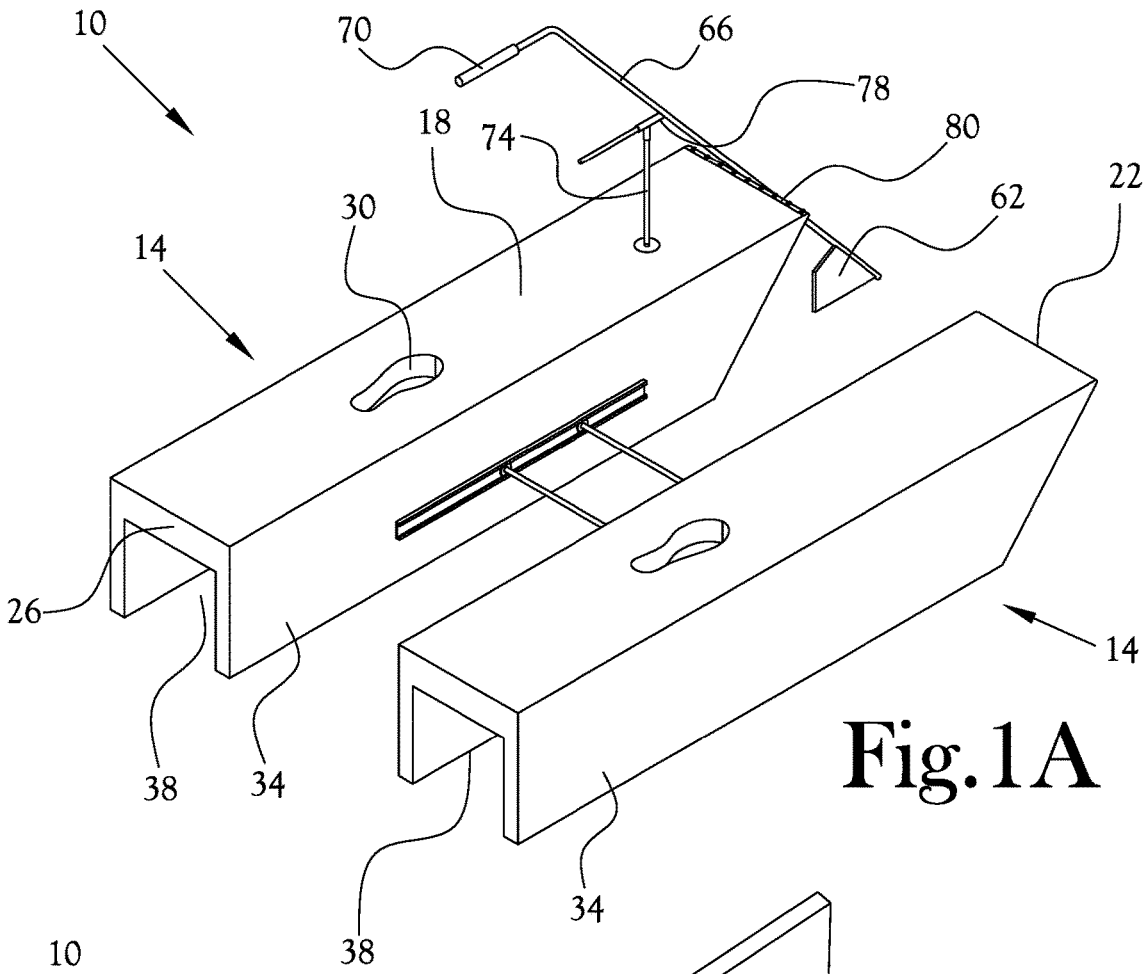
FIGS. 1A-B illustrate two perspective views of a user propelled flotation and transportation system according to an example embodiment of the present general inventive concept.
Figure 1B:
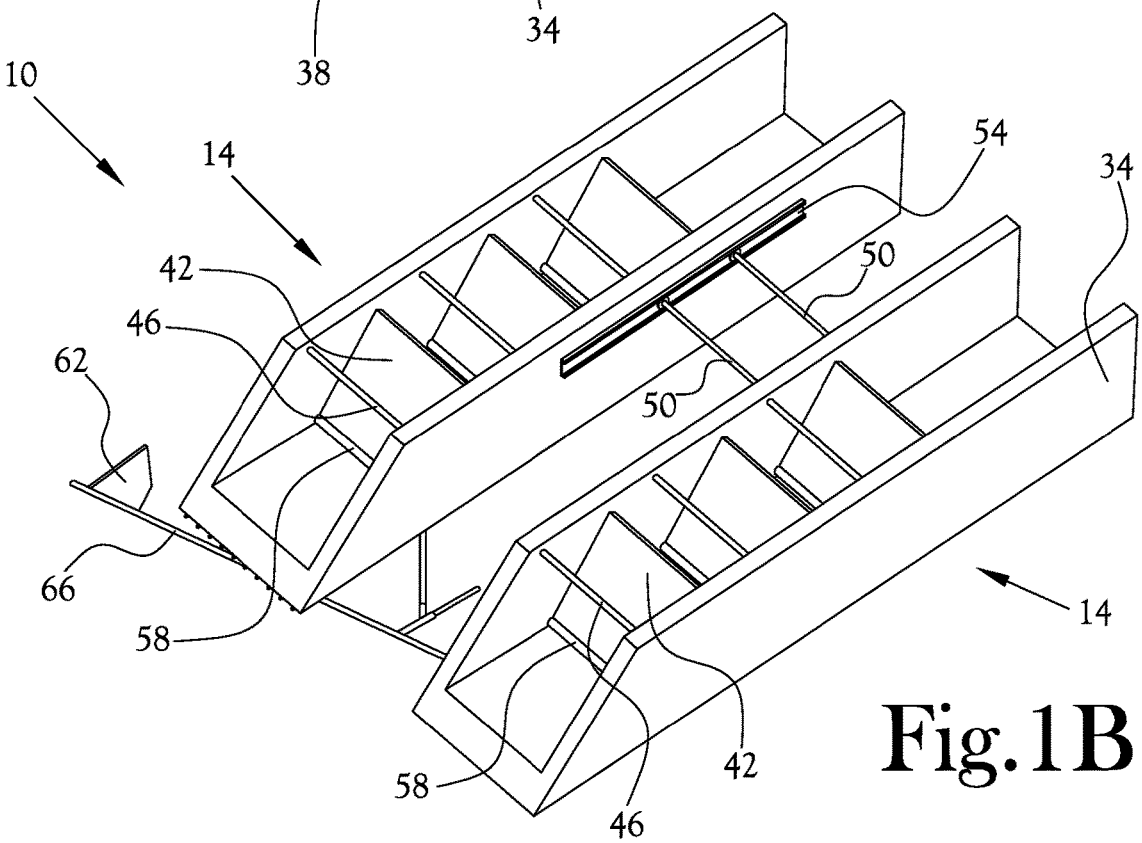

FIGS. 1A-B illustrate two perspective views of a user propelled flotation and transportation system 10 according to an example embodiment of the present general inventive concept. FIG. 1A illustrates a perspective view of the front and right sides of first and second buoyant floats 14 of the system 10, and FIG. 1B illustrates a perspective view of the bottom and right sides of the floats 14. At least a main body portion, which may be referred to herein as the hull, 18 of the floats 14 is formed of a buoyant material or materials so that the floats 14 do indeed still float when a user utilizes the system for transportation across the water surface. In various example embodiments the floats may be formed of a dense foam material, a hollow plastic body, and so on. As illustrated in FIGS. 1A-B, each of the first and second buoyant floats 14 have the main body or hull 18 which are formed in an elongate fashion having a forward end 22 and a rear end 26. A foot receiving portion 30 is provided on a top surface of each of the floats 14 to allow a user to place their feet in position for operating the system 10. In the example embodiment illustrated in FIGS. 1A-B, the foot receiving portion is formed as a recessed portion that has the general outline of a human foot, with the left foot configuration on the left float 14, and the right foot configuration on the right float 14. Various example embodiments may provide recessed foot receiving portions of various depths, and may be fitted with intermittent or continuous border members so as to cause a friction fit with the user's feet or shoes, so that the user can simply step into the foot receiving portions and have a "grip" that allows operation of the system. Various example embodiments of the present general inventive concept may provide a host of differently configured foot receiving portions. For example, various example embodiments may not have a recessed portion at all, but rather have other types of securement and/or indicia to easily show a user where to place his or her feet and secure them thereto.

Each of the floats 14 includes a pair of fins 34 extending downward from the hull 18 and along a length of the hull 18. Each pair of fins 34 are arranged to be substantially parallel to form a channel 38 along a bottom surface of the hull 18 through which water will move during at least some of the operations of the system 10. In the example embodiment illustrated in FIGS. 1A-B, the fins 34 are formed integrally with the hulls 18, and extend from the outer edges of the hulls 18 along an entire length of the hulls 18. However, various example embodiments may provide a host of different configurations without departing from the scope of the present general inventive concept. For example, the fins 34 may be formed of a different material than the hulls 18, and/or may not be formed integrally with the hulls 18. In various example embodiments the fins 34 may not run along an entire length of the hulls 18, and/or may have varying depths and/or widths. In the example embodiment illustrated in FIGS. 1A-B, the forward ends of the fins 34 taper back to allow easier movement through the water when the floats are being moved forward in a walking operation. The forward ends 22 of the hulls 18 are also tapered to match the taper of the fins 34 in the example embodiment, but various other example embodiments may have different configurations.

As illustrated in FIG. 1B, a plurality of flaps 42 are arranged between the fins 43 of each of the floats 14. These flaps 42 are configured so as to reach substantially from side to side of the respective channels 38, terminating at the sides in close proximity to the respective inner surfaces of the flaps 42. The flaps 42 are configured to have a pivoting relationship about a point or line between the fins 43 and proximate the bottom surface of the hull 18. In more detail, a top end of each of the flaps 42 is arranged so as to be connected to the bottom surface of the hull 18, or near a top of the fins 34, so that the flaps 42 can move in a pivoting fashion about those points according to pressure from the water moving through the channel relative to the hulls 18 and fins 34. When a float 14 is moved forward, water is effectively moving backward in the channel 38 relative to the hull 18 of the float 14, and vice versa. In various example embodiments, the tops of the flaps may be attached proximate each edge to the bottom of the hull 18 or near the top inner surface of the fins 34, and configured so that the flaps 42 can move between a substantially vertical first position extending away from the bottom surface of the hull 18, and a second position in which the flaps 42 have rotated back in a direction toward a rear end 26 of the hull 18 so that the flaps 42 are folded back to at least approach the bottom surface of the hull 18. In this example embodiment the flaps 42 are configured so as to have a rotating hinge connection 58 about a hinge rod received through a top portion of the flaps 42, the hinge rod being connected at each respective end to facing inner surfaces of the fins 34. Thus, the hinge rod is the line about which the flaps 42 pivot or rotate. While the rear rotation of the flaps 42 may be simply limited by contact with the bottom surface of the hull 18, the rotation in the opposite direction is limited by a plurality of respective mechanical stops or rods 46 extending between inner surfaces of the fins 34 so as to make contact with the flaps 42 and stop the rotation of the flaps 42 in the direction toward the front end 22 of the hull 18. The movement of the flaps 42 are illustrated in FIGS. 2A-D.

Figure 2A:
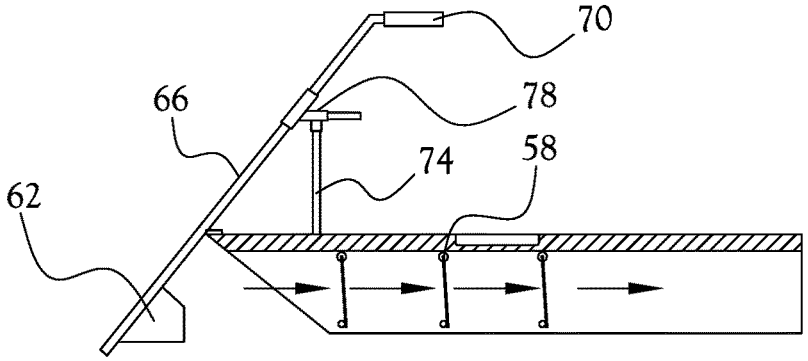
FIGS. 2A-D illustrate cross sections of one of the buoyant floats of FIGS. 1A-B during different stages of operation of the system according to an example embodiment of the present general inventive concept.
Figure 2B:
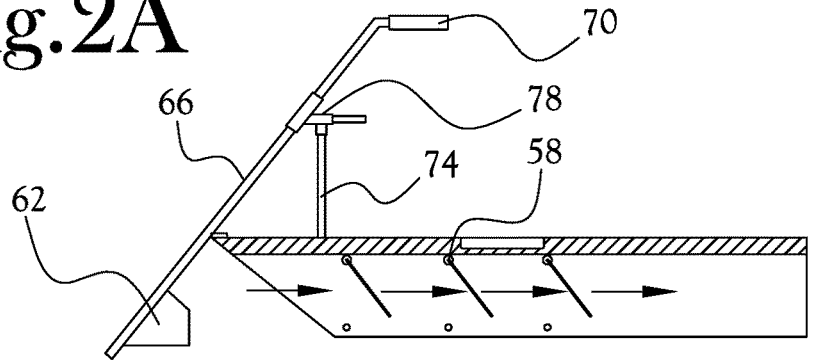
Figure 2C:
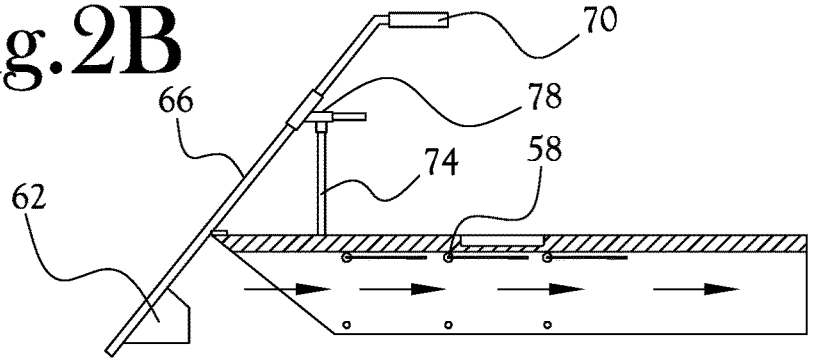
Figure 2D:
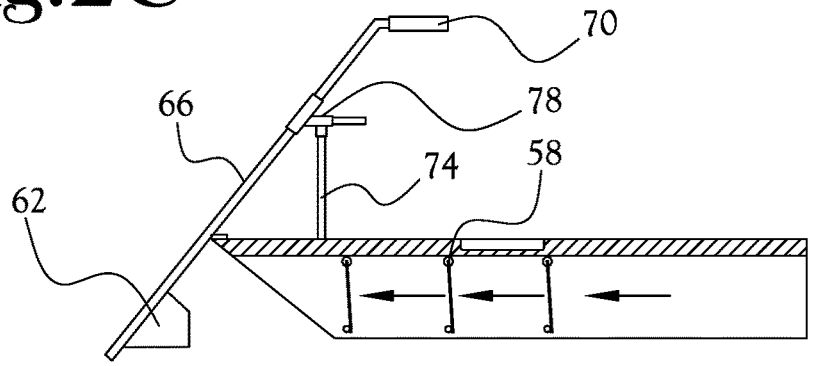

FIGS. 2A-D illustrate cross sections of one of the buoyant floats 14 of FIGS. 1A-B during different stages of operation of the system according to an example embodiment of the present general inventive concept. FIG. 2A illustrates a state of operation of the system 10 just as a forward "step" is about to be taken. Each of the flaps 42 are extended downward and rotated forward so far as to be in contact with the rods 46 which stop the forward rotational movement of the flaps 42. The arrows in FIG. 2A indicate the direction of water in the channel 38, relative to the hull 18 which is starting to move forward, as the movement is started. FIG. 2B illustrates a state of operation just after that illustrated in FIG. 2A, when the user is striding forward with his or her foot attached to the illustrated float 14. As illustrated in FIG. 2B, the forward movement of the float 14 causes the relative back direction of the water in the channel 38, which forces the flaps 42 to rotate back in the direction of the rear end 26 of the hull 18. FIG. 2C illustrates a state of operation just after that illustrated in FIG. 2B, and shows that the continued forward movement of the float 14 has channeled water back through the channel 38 such that the flaps 42 have been forced all the way back to contact the bottom surface of the hull 18. Thus, as illustrated in FIGS. 2A-C, the flaps 42 move freely backwards so as to provide little resistance to the water in the channel 38, allowing the user to easily stride forward with the float 14. FIG. 2D illustrates the end of the forward movement operation, at which point the user strides forward with the other float 14 and stops forward movement of the float 14 illustrated in FIG. 2D. As illustrated, once the forward movement has stopped, gravity causes the flaps 42 to rotate downward, in a direction toward the forward end 22 of the hull 18, until the flaps 42 contact mechanical stops or rods 50. The movement of the flaps 42 toward the rods 50 may be hastened by the user providing a back stride force on the float 14 when providing a forward force to the other float 14. As such, because the flaps 42 are closing off large cross sections of the channel 38 when the water is trying to move forward through the channel 38 relative to the float 14, the blocking of that water flow essentially provides a propelling force to the user moving the other float 14 forward. The flaps 42 stay in this blocking position until the user begins another forward stride with this float 14, as in the operation illustrated in FIG. 2A. It is noted that while the flaps 42 are arranged in a hinged connection 58 about a rod crossing between inner surfaces of the fins 34 in this example embodiment of the present general inventive concept, various other example embodiments may provide a host of different configuration. For example, the flaps 42 may be provided with hinged connections at either side of the top of the flaps 42, such as a male and female arrangement, which has a built in limiter to stop the forward and/or backward rotation of the flaps 42. Similarly, while this example embodiment includes the rods 46 extending across the entirety of the channel 38 between the fins 34, various other example embodiments may provide other types of mechanical stops, such as short studs, knobs, rails, etc., to limit the forward rotation. Also, while this example embodiment illustrates three flaps 42 arranged between each pair of fins 34, and at substantially equidistant spacing, other example embodiments may provide fewer or more such flaps. In various example embodiments, a plurality of flaps may be mechanically coupled to one another, such as by a bar with a rolling pin, or other such pivoting member, to facilitate constant positioning of the flaps relative to one another during the different operations of movement. In the example embodiment illustrated in FIGS. 2A-D, the flaps 42 do not extend outside of the channel 38 past the fins 34 at any position of rotation, but in other example embodiments the flaps 42 may extend outside of the fins 34. Arrangements in which the flaps 42 do not extend past the fins 34 may provide more convenient storage for the system 10 when not in use, such as when disassembled and stored away after use.

Figure 3A:
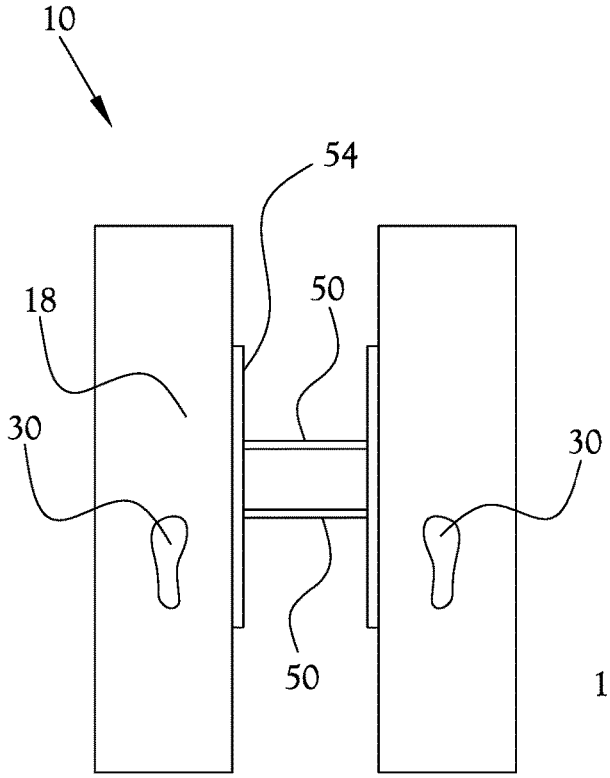
FIGS. 3A-B illustrate partial top views of coupled buoyant floats in different stages of operation according to an example embodiment of the present general inventive concept.
Figure 3B:
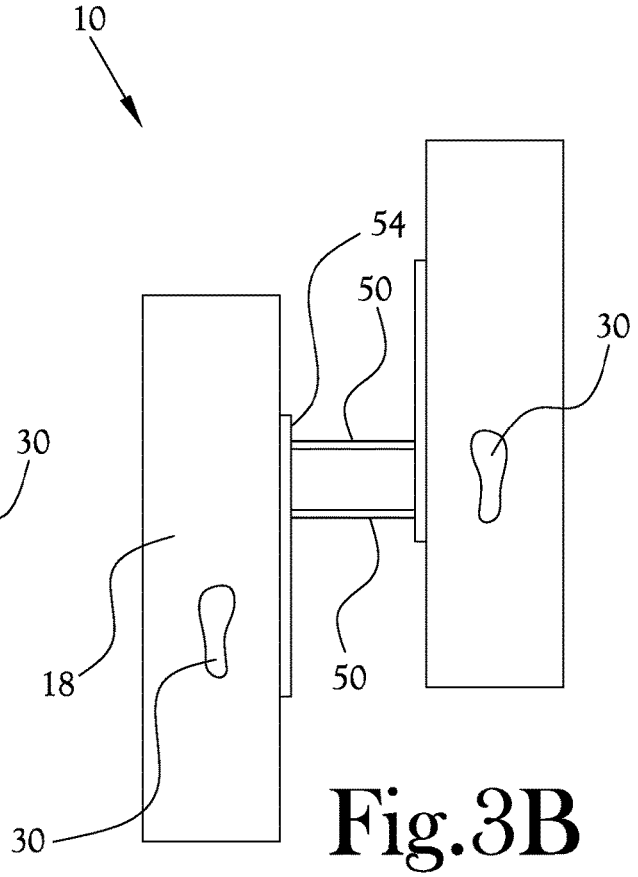

Referring again to FIGS. 1A-B, the user propelled flotation and transportation system 10 of this example embodiment includes a coupling assembly configured to couple the first and second floats 14 to one another such that the floats 14 maintain a substantially constant distance between one another, and move substantially parallel to one another, when in use. A plurality of coupling rods 50 may be coupled at either end to respective runners 54 attached to facing surfaces of the floats 14. This arrangement allows the ends of the coupling rods 50 to move relative to the respective runners 54 as the floats are moving relative to one another during a striding operation. The plurality of rods 50 may be spaced apart from one another by a cross member or other such connecting member in various example embodiments. In the example embodiment illustrated in FIGS. 1A-B, the runners 54 are configured to form grooves which hold the ends of the rods 50 therein but allow them to move forward and back during the movement of the floats 14. FIGS. 3A-B illustrate partial top views of coupled buoyant floats in different stages of operation according to an example embodiment of the present general inventive concept. As illustrated in FIGS. 3A-B, the longitudinal axes of the floats 14 are maintained so as to be substantially parallel by the coupling rods 50 acting in concert with the runners 54 provided to the facing surfaces of the floats 14. Further, the distance between the floats 14 is maintained during the movement of the floats. Such stability in movement greatly aids the user when engaged in using the system for water transportation, as this prevents misalignment between the two floats, or one side sinking too far due to uneven weight distribution, and so forth. In various example embodiments, the rods 50 may be configured with substantially flat ends that are held in the runner grooves, or rolling elements to roll within the grooves, and so on. In other example embodiments the runners 54 may be formed with a T-shaped cross section, and the ends of the rods may be formed so as to wrap around the T-shaped runners to slide along the length thereof. In various example embodiments the runners 54 may be provided with mechanical stops at ends thereof to prevent the rods from running out of the runners. In various example embodiments one or more of these mechanical stops may be configured to be selectively opened by a user so as to provide easy and convenient disassembly of the system 10 for storage after use. Also, which the example embodiment illustrated in FIGS. 1A-B illustrated the runners 54 being located proximate the bottom of the fins 34, it is understood that the runners may be placed higher, e.g., proximate a top edge of the hulls 18, without departing from the scope of the present general inventive concept.

In various example embodiments the system 10 may include a rudder assembly arranged on at least one of the floats 14. In the example embodiment illustrated in FIGS. 1A-B, a rudder arm 66 is provided on the leftmost float and arranged such that a distal end of the rudder arm 66 extends past the forward end 22 of the hull 18 such that a rudder 62 attached proximate the distal end of the rudder arm 66 is below the bottom surface of the hull 18. A rudder support member 74 is attached to the top surface of the hull 18, and is coupled to the rudder arm 66 in a pivoting assembly 78 to allow movement of the rudder 62 both up and down, as well as side to side, relative to the hull 18. A handle 70 is provided at a proximal end of the rudder arm, and a plurality of slots 80 are arranged on the forward end 22 of the hull 18 and configured to hold the rudder arm 66 in any of the slots 80 selected by the user. Thus, this assembly provides a user interface that allows a user to quickly and easily change direction of the system in use by simply gripping the handle 70 and pushing downward to raise the rudder arm 66 out of the current slot in which it rests, and moving the handle 70 to one side or the other to position the rudder 62 in the desired directional position, and then moving the handle 70 up to allow the rudder arm 66 to rest and be secured in the newly selected slot 80. The plurality of slots 80 may be formed integrally with the hull 18 in various example embodiments of the present general inventive concept, or may be provided as a slotted member attached to the hull 18. In some example embodiments the slots 80 maybe formed to provide friction fits with the rudder arm 66 to provide a more secure hold in the desired position. The rudder assembly may also be used by the user for stabilization, similar to a walking stick, during the walking operation. The rudder support member 74 may be selectively attached and detached to the hull 18 for easy assembly and disassembly of the system 10. In various example embodiments of the present general inventive concept, the hulls 18 may be provided with receiving portions or other such couplings to selectively receive upright poles that may be used in the fashion of walking sticks, or ski poles, by a user, so as to provide more stabilization.

Figure 4:
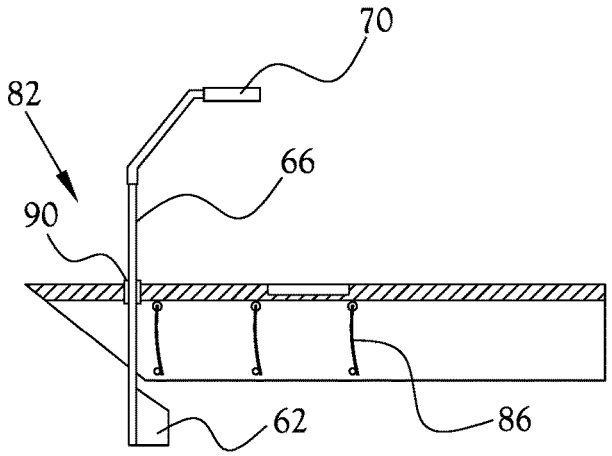
FIG. 4 illustrates a cross section of a buoyant float of a user propelled flotation and transportation system according to another example embodiment of the present general inventive concept.
Figure 5:
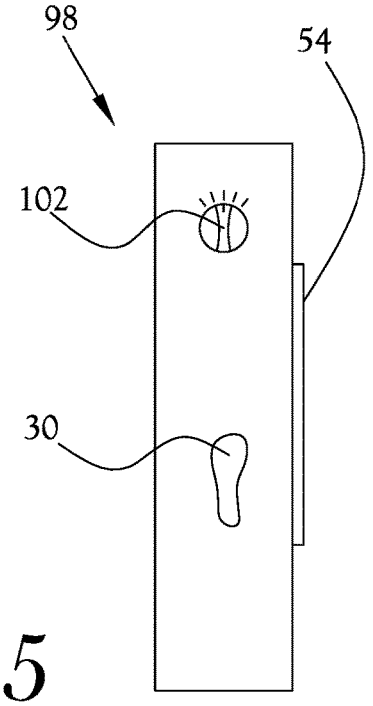
FIG. 5 illustrates a partial top view of a buoyant float according to still another example embodiment of the present general inventive concept.

FIG. 4 illustrates a cross section of a buoyant float of a user propelled flotation and transportation system 82 according to another example embodiment of the present general inventive concept. In the example embodiment illustrated in FIG. 4, the system 82 includes a plurality of curved flaps 86 that are formed to provide a cupping action that can facilitate the forward rotation of the flaps 86 when the water is moving forward through the channel relative to the hull 18. The curved shape can also facilitate a smoother back rotation of the flaps 86 when the water is moving backward through the channel relative to the hull 18. The system 82 also employs another example embodiment of a rudder assembly. In the rudder assembly of FIG. 4, the rudder arm 66 passes through the hull 18, rather than over an end thereof, and is configured for rotational movement to position the rudder 62 for the desired direction of movement. Thus, in this example embodiment the user can simply use the handle 70 to rotate the rudder arm 66, and the handle 70 may be configured to point in the same direction as which the rudder 62, to aid in easy positioning by the user. In this example embodiment, a securing member 90 is provided to hold the rudder arm 66 at the desired point of rotation. In various example embodiments the securing member may simply be a friction fitting through which the rudder arm 66 extends. In other example embodiments the securing member 90 may be arranged to fit securely to the rudder arm 66, and have an external system of notches with a flexible stop member, and so on, to allow a user to secure the rudder in one of a number of pre-formed positions. FIG. 5 illustrates a partial top view of a buoyant float 98 according to still another example embodiment of the present general inventive concept. In the example embodiment illustrated in FIG. 5, the rudder arm 66 passes through the hull 18, similar to the embodiment illustrated in FIG. 4, but rather than extending upward above the top surface of the hull 18, the rudder arm 66 terminates under a rotational member 102 that controls rotational movement of the rudder arm 66. In the example embodiment illustrated in FIG. 5, the rotational member 102 is configured as a dial, with indicia showing a user how to position the rudder 66, and therefore the rudder 62, in the desired direction. As previously described, the rudder arm may be subject to a friction fit under the rotational member 102, or the rotational member 102 may have an assembly of stops or slots or the like that interact to hold a desired position.

Figure 6A:
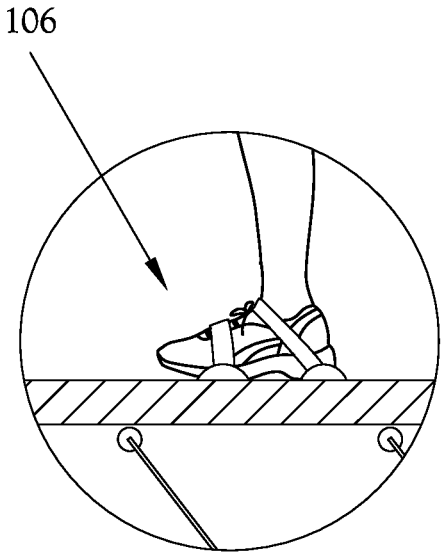
FIGS. 6A-B illustrate different foot receiving portions of a user propelled flotation and transportation system according to other example embodiments of the present general inventive concept.
Figure 6B:
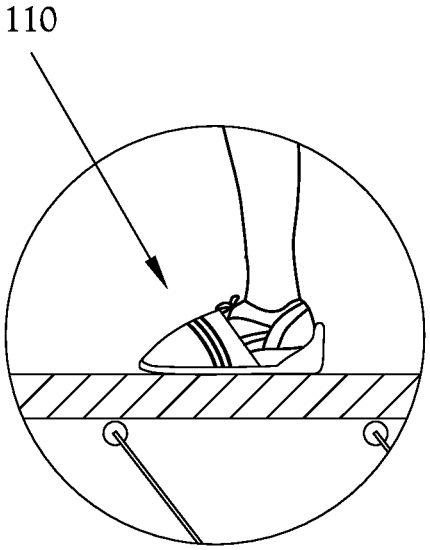

FIGS. 6A-B illustrate different foot receiving portions of a user propelled flotation and transportation system according to other example embodiments of the present general inventive concept. In the example embodiment illustrated in FIG. 6A, the foot receiving portion is formed as a plurality of foot straps 106 that can be secured over a shoe, bare foot, etc., to allow quick and easy attachment of the floats 14. Indicia may be formed on the top surface of the hull to aid in the placement of the foot in the straps 106, or in some example embodiments the straps 106 may be used along with a recessed foot receiving portion formed in the top surface of the hull. In the example embodiment illustrated in FIG. 6B, the foot receiving portion is formed as a binding assembly 110, similar to those found on water skis, to allow a user to quickly enter the foot into the binding assembly 110 for attachment of the floats 14. As previously discussed, at least some elements of a binding assembly 110 or similar accommodations may be formed in conjunction with a recessed foot receiving portion formed in the top surface of the hull.

Figure 7:
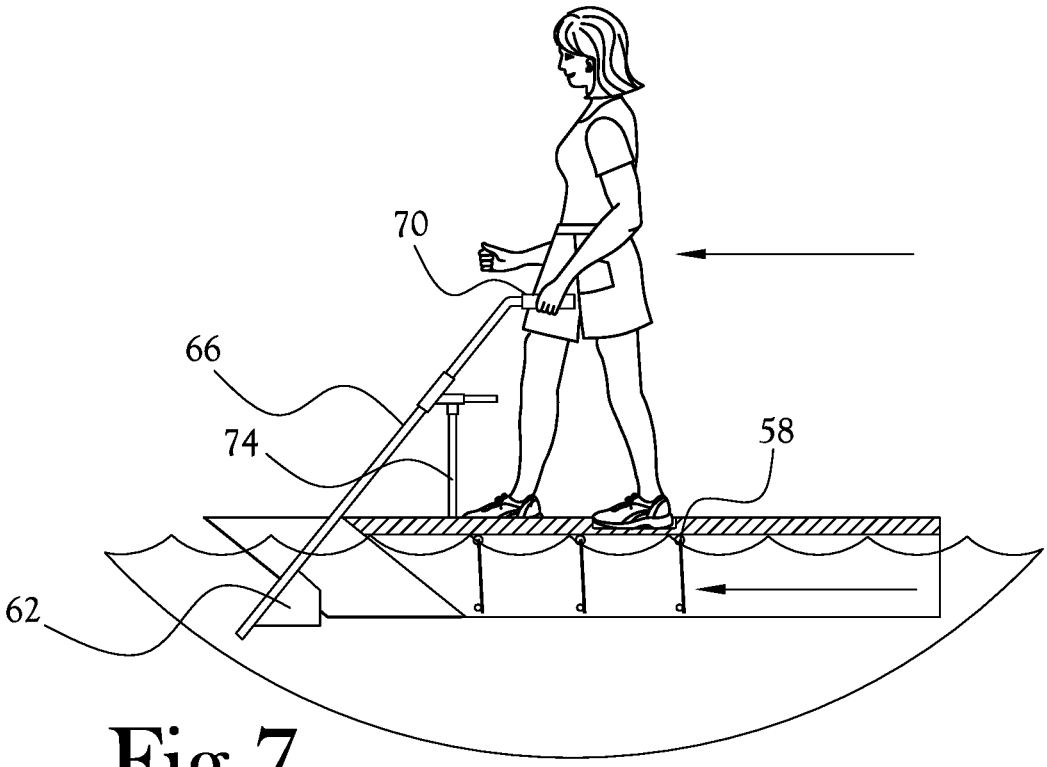
FIG. 7 illustrates a user operating the user propelled flotation and transportation system of FIG. 1.

FIG. 7 illustrates a user operating the user propelled flotation and transportation system of FIG. 1. As illustrated, the user can move across the surface of the water simply by moving the feet forward one at a time, as in a normal walking operation. While the non-moving foot may be at least slightly "kicking off" movement during a normal walking operation, that aspect can be approximated with the illustrated system due to the flaps moving down and blocking undesired flow of water through the channels of the floats. Further, with the rudder assembly shown in FIG. 7, the user can utilize the handle for added stability during a walking operation. In various example embodiments of the present general inventive concept, the size of the floats may be chosen according to an expected weight range of the user. For example, a pair of floats may be formed at a certain length and/or width for the 100 to 130 pound user, and another pair of floats may be formed at another length and/or width for the 200 to 230 pound user. By taking such factors into account during production, a light user does not have to try to operate overlarge floats, and a heavier user can be provided a system that provides more buoyancy. While the example embodiments described herein have been discussed as being used by one walker, other various example embodiments can be utilized by more than one walker. For example, two foot receiving portions can be provided on floats that have been designed for the extra weight, so that two users can operate the same system in tandem. Also, as discussed herein, various components of the system of the present general inventive concept may be configured to be selectively attached and detached to the hull or other parts of the floats to as to break down to an easily manageable size for storage and transportation.

Various example embodiments of the present general inventive concept may provide a user propelled flotation and transportation system, the system including first and second buoyant floats configured to be selectively attached and detached to a user's feet, each of the first and second floats including an elongate hull having a forward end and a rear end, a foot receiving portion provided on a top surface of the hull, a pair of fins extending downward along a length of the hull and arranged to be substantially parallel to form a channel along a bottom surface of the hull, and one or more flaps arranged between the fins and configured to pivot about a line between the fins that is proximate the bottom surface of the hull, wherein the one or more flaps are configured to be movable between a first position extending downwardly from the bottom surface of the hull, and a second position rotated back toward the rear end of the hull. Each of the one or more flaps may be limited at the first position in forward rotation by a respective mechanical stop provided on facing surfaces of the fins. The mechanical stop may be a rod extending between the facing surface of the fins. Each of the one or more flaps may substantially block the channel when in the first position. The one or more flaps may be a plurality of flaps. The plurality of flaps may be mechanically linked so as to move in unison. The one or more flaps may be configured to be at least partially arcuate, curving toward the rear end of the float. The one or more flaps may be configured so as to not extend outside the channel in any position. The system may further include a coupling assembly configured to couple the first and second buoyant floats to one another such that the first and second buoyant floats maintain a substantially constant distance between one another. The coupling assembly may be configured such that the first and second buoyant floats move in a substantially parallel fashion when operated by a user. The coupling assembly may include first and second runners respectively provided along facing surfaces of the first and second buoyant floats, and a plurality of coupling rods coupled at each respective end to the first and second runners so as to allow reciprocating movement forward and backward along the first and second runners. The coupling rods may be respectively attachable and detachable from the first and second runners to facilitate disassembly of the system for storage. The coupling rods may include rollers provided at each of the respective ends, and the first and second runners may be configured to secure the rollers therewithin while allowing the rollers to roll forward and backward. The system may further include mechanical stops provided at ends of the first and second runners to prevent the coupling rods from becoming detached from the first and second runners, at least one of the mechanical stops provided to each of the first and second runners being selectively openable to disassemble the coupling rods from the first and second runners. The system may further include a rudder assembly arranged on the first buoyant float, the rudder assembly including a rudder arm configured to be selectively positionable in a plurality of secured positions, a rudder arranged proximate a distal end of the rudder arm, and a user interface configured such that the rudder arm is securable in a desired position by a user to place the rudder in a desired direction. The rudder arm may extend over the forward end of the hull of the first buoyant float such that the rudder extends below the hull, and such that a proximal end of the rudder arm extends over the top surface of the hull, and the user interface may include a handle provided on the proximal end of the rudder arm, a rudder support member attached to the top surface of the hull and configured to support the rudder arm in a pivoting relationship, and a plurality of slots provided on the forward end of the hull and configured with a plurality of slots each configured to hold the rudder arm therein when a user selectively places the rudder arm into a chosen slot. The rudder arm may extend through the hull of the first buoyant float such that the rudder extends below the hull, and wherein the user interface may include a rotating member provided on the top surface of the hull and attached to a proximal end of the rudder arm to control a rotation thereof, the rotating member being configured to be selectively positionable in a plurality of positions configured to hold the rudder arm in the desired position. The foot receiving portion may be configured as a recessed position to hold a foot of the user. The foot receiving portion may include one or more members to fit over one or more areas of a user's foot to secure the foot to the hull.

Various example embodiments of the present general inventive concept may provide a user propelled flotation and transportation system, the system including first and second buoyant floats configured to be selectively attached and detached to a user's feet, each of the first and second floats including an elongate hull having a forward end and a rear end, a foot receiving portion provided on a top surface of the hull, a pair of fins extending downward along a length of the hull and arranged to be substantially parallel to form a channel along a bottom surface of the hull, and a plurality of flaps arranged between the fins and configured to pivot about a line between the fins that is proximate the bottom surface of the hull, wherein the plurality of flaps are configured to be movable between a first position extending downwardly from the bottom surface of the hull, and a second position rotated back toward the rear end of the hull, a coupling assembly configured to couple facing surfaces of the first and second buoyant floats to one another such that the first and second buoyant floats maintain a substantially constant distance between one another, and move along substantially parallel lines, while in operation, and a rudder assembly arranged on the first buoyant float, the rudder assembly including a rudder arm configured to be selectively positionable in a plurality of secured positions by a user, a rudder arranged proximate a distal end of the rudder arm, and a user interface configured such that the rudder arm is securable in a desired position by the user to place the rudder in a desired direction.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A user propelled flotation and transportation system, the system comprising:

first and second buoyant floats configured to be selectively attached and detached to a user's feet, each of the first and second floats comprising:

an elongate hull having a forward end and a rear end, a foot receiving portion provided on a top surface of the hull, a pair of fins extending downward along a length of the hull and arranged to be substantially parallel to form a channel along a bottom surface of the hull, and a plurality of flaps arranged between the fins and configured to pivot about a line between the fins that is proximate the bottom surface of the hull, wherein the plurality of flaps are configured to be movable between a first position extending downwardly from the bottom surface of the hull, and a second position rotated back toward the rear end of the hull, and wherein the plurality of flaps are mechanically linked so as to move in unison.

2. The system of claim 1, wherein each of the plurality of flaps is limited at the first position in forward rotation by a respective mechanical stop provided on facing surfaces of the fins.

3. The system of claim 2, wherein the mechanical stop is a rod extending between the facing surface of the fins.

4. The system of claim 1, wherein each of the plurality of substantially blocks the channel when in the first position.

5. The system of claim 1, wherein the plurality of flaps are configured to be at least partially arcuate, curving toward the rear end of the float.

6. The system of claim 1, wherein the plurality of flaps are configured so as to not extend outside the channel in any position.

7. The system of claim 1, further comprising a coupling assembly configured to couple the first and second buoyant floats to one another such that the first and second buoyant floats maintain a substantially constant distance between one another.

8. The system of claim 7, wherein the coupling assembly is configured such that the first and second buoyant floats move in a substantially parallel fashion when operated by a user.

9. The system of claim 7, wherein the coupling assembly comprises:

first and second runners respectively provided along facing surfaces of the first and second buoyant floats; and a plurality of coupling rods coupled at each respective end to the first and second runners so as to allow reciprocating movement forward and backward along the first and second runners.

10. The system of claim 9, wherein the coupling rods are respectively attachable and detachable from the first and second runners to facilitate disassembly of the system for storage.

11. The system of claim 9, wherein the coupling rods include rollers provided at each of the respective ends, and wherein the first and second runners are configured to secure the rollers therewithin while allowing the rollers to roll forward and backward.

12. The system of claim 9, further comprising mechanical stops provided at ends of the first and second runners to prevent the coupling rods from becoming detached from the first and second runners, at least one of the mechanical stops provided to each of the first and second runners being selectively openable to disassemble the coupling rods from the first and second runners.

13. The system of claim 1, further comprising a rudder assembly arranged on the first buoyant float, the rudder assembly comprising:

a rudder arm configured to be selectively positionable in a plurality of secured positions;

a rudder arranged proximate a distal end of the rudder arm; and a user interface configured such that the rudder arm is securable in a desired position by a user to place the rudder in a desired direction.

14. The system of claim 13, wherein the rudder arm extends over the forward end of the hull of the first buoyant float such that the rudder extends below the hull, and such that a proximal end of the rudder arm extends over the top surface of the hull, and wherein the user interface comprises:

a handle provided on the proximal end of the rudder arm;

a rudder support member attached to the top surface of the hull and configured to support the rudder arm in a pivoting relationship; and a plurality of slots provided on the forward end of the hull and configured with a plurality of slots each configured to hold the rudder arm therein when a user selectively places the rudder arm into a chosen slot.

15. The system of claim 13, wherein the rudder arm extends through the hull of the first buoyant float such that the rudder extends below the hull, and wherein the user interface comprises:

a rotating member provided on the top surface of the hull and attached to a proximal end of the rudder arm to control a rotation thereof, the rotating member being configured to be selectively positionable in a plurality of positions configured to hold the rudder arm in the desired position.

16. The system of claim 1, wherein the foot receiving portion is configured as a recessed position to hold a foot of the user.

17. The system of claim 1, wherein the foot receiving portion comprises one or more members to fit over one or more areas of a user's foot to secure the foot to the hull.

18. A user propelled flotation and transportation system, the system comprising:

first and second buoyant floats configured to be selectively attached and detached to a user's feet, each of the first and second floats comprising:

an elongate hull having a forward end and a rear end, a foot receiving portion provided on a top surface of the hull, a pair of fins extending downward along a length of the hull and arranged to be substantially parallel to form a channel along a bottom surface of the hull, and one or more flaps arranged between the fins and configured to pivot about a line between the fins that is proximate the bottom surface of the hull, wherein the one or more flaps are configured to be movable between a first position extending downwardly from the bottom surface of the hull, and a second position rotated back toward the rear end of the hull;

a rudder assembly arranged on the first buoyant float, the rudder assembly comprising:

a rudder arm configured to be selectively positionable in a plurality of secured positions, a rudder arranged proximate a distal end of the rudder arm, and a user interface configured such that the rudder arm is securable in a desired position by a user to place the rudder in a desired direction, wherein the rudder arm extends through the hull of the first buoyant float such that the rudder extends below the hull, and wherein the user interface comprises:

a rotating member provided on the top surface of the hull and attached to a proximal end of the rudder arm to control a rotation thereof, the rotating member being configured to be selectively positionable in a plurality of positions configured to hold the rudder arm in the desired position.

* * * * *